US007578307B2

(12) United States Patent
Ung et al.

(10) Patent No.: US 7,578,307 B2
(45) Date of Patent: Aug. 25, 2009

(54) PORTABLE, COLLAPSIBLE SHELTERS

(76) Inventors: Dana Macy Ung, P.O. Box 15105, Stanford, CA (US) 94309; Robert E. Skelton, 445 Sea La., La Jolla, CA (US) 92037-4950; Jean-Paul Pinuad, 9716 Caminito de la Fada, San Diego, CA (US) 92124

( * ) Notice: Subject to any disclaimer, the term of this patent is extended or adjusted under 35 U.S.C. 154(b) by 857 days.

(21) Appl. No.: 10/394,101

(22) Filed: Mar. 19, 2003
(Under 37 CFR 1.47)

(65) Prior Publication Data

US 2004/0261351 A1 Dec. 30, 2004

(51) Int. Cl.
*E04H 15/44* (2006.01)
*E04B 7/08* (2006.01)

(52) U.S. Cl. ..... 135/128; 135/120.4; 135/123; 52/81.1; 52/645; 52/652.1

(58) Field of Classification Search ..... 135/125–128, 135/120.4, 144, 123, 115; 52/81.1–81.5, 52/641, 645, 646, 83, 108, 109, 652.1
See application file for complete search history.

(56) References Cited

U.S. PATENT DOCUMENTS 3,063,521 A * 11/1962 Fuller ..... 52/646
3,169,611 A * 2/1965 Snelson ..... 52/648.1
3,710,806 A * 1/1973 Kelly et al. ..... 135/145
3,771,274 A * 11/1973 Vaughan ..... 52/646
3,866,366 A * 2/1975 Fuller ..... 52/81.2
4,026,312 A * 5/1977 Beavers ..... 135/147
4,148,520 A * 4/1979 Miller ..... 297/16.2
5,642,590 A * 7/1997 Skelton ..... 52/81.1
6,542,132 B2 * 4/2003 Stern ..... 343/915
6,868,640 B2 * 3/2005 Barber ..... 52/81.1
6,901,714 B2 * 6/2005 Liapi ..... 52/645

FOREIGN PATENT DOCUMENTS

WO WO 03/002830 * 1/2003

* cited by examiner

*Primary Examiner*—Winnie Yip
(74) *Attorney, Agent, or Firm*—Fish & Richardson P.C.

(57) ABSTRACT

A lightweight, deployable, portable shelter is described. The portable shelter may be a tent. The tent can be used indoors as well as outdoors. The structure of the portable shelter is determined by compression elements and tensile members such that the compression elements do not touch. The forces acting on each component of the structure are axially-loaded, thereby taking advantage of the characteristics of the compression elements and tensile members to provide a tent with improved strength.

2 Claims, 13 Drawing Sheets

PORTABLE, COLLAPSIBLE SHELTERS

TECHNICAL FIELD

The present invention generally relates to portable, collapsible shelters, in particular, tents.

BACKGROUND

Camping is an activity that is much enjoyed by both adults and children. People camp to enjoy the outdoors, whether it is at a national park or in their own backyard. Children also like to camp in their homes. Part of the camping experience usually included sleeping in portable, collapsible shelters, usually referred to as tents. The interest in camping has produced many types of tents suited to the particular needs of the camper.

To date, tents available in the marketplace are deployable structures generally characterized by a combination of trusses or struts that are interconnected in a manner that enables the structure to be articulated between a collapsed, retracted or stowed configuration and a deployed configuration. Advantages of deployable structures include improved efficiency because a deployable structure can be entirely assembled during manufacture rather than in the field, improved design performance because greater precision can typically be attained for units assembled during manufacture than for those requiring field assembly, and lower transportation costs because collapsed units are more compact for storage and shipping.

These deployable structures generally involve a truss structure that employs heavy trusses, which are mechanically interconnected with pins, welds or bolts. Because of the manner in which the trusses are secured directly together, this type of deployable structure tends to be relatively heavy for the degree of stiffness and strength of the structure that is achieved.

SUMMARY

In a general aspect, the invention includes a deployable structure whose shape can be controlled and altered to modify its size, stiffness and/or damping characteristics. More particularly, this invention relates to a lightweight deployable structure that is capable of large displacements to achieve a variety of shapes with controlled precision, capable of being returned to a desired shape after being subjected to a disturbance force, and characterized by enhanced vibration isolation.

In one aspect, the invention is a portable shelter having at least 3 compression elements (also referred to as struts). The invention can have up to 20 compression elements, in other words it may have 4, 5, 6, 7, 8, 9, 10, 11, 12, 13, 14, 15, 16, 17, 18, 19, or 20 compression elements. The number of compression elements can be greater than 20, limited only in the practicality of using a larger number of compression elements, for example, convenience of use, portability, and storage.

The compression elements are connected to each other by a tensile member (also referred to as a tension member or tendon). The tensile member can be a single structural piece. The invention also contemplates more than one tensile member, wherein a tensile member may connect at least one compression element to another compression element. A tensile member may connect a series of compression elements. Tensile members can also be referred to as horizontal tensile members and vertical tensile members, depending on what portion of the compression elements the tensile member is connecting. The horizontal tensile member(s) connect the compression elements generally in a horizontal manner. The vertical tensile member(s) connect the compression elements generally in a vertical manner.

In another aspect, the invention may comprise different complexities with respect to the interrelation between the compression elements and the tensile members. For example, in one embodiment, the invention has a single level of compression elements. In another embodiment, the invention has two levels of compression elements. In still another embodiment, the invention has three or more levels of compression elements.

In still another aspect, the invention has a covering. The covering can be used to enclose the structure to enclose the shelter. The covering may be complete, including a floor, side walls and a roof. Or, the covering can be partial wherein any one of a floor, one or more of the side walls, or a roof is not present. It is further contemplated that the covering may be a single structure or be made of multiple pieces of material.

In yet another aspect, the covering can also provide the same function as some of the tensile members.

In another general aspect, the tension members can be adapted to be manipulated in order to precisely articulate the compression elements and thereby enable the deployable structure to attain a desired shape and/or achieve a desired stiffness.

It still another general aspect, the invention can include a tensioning apparatus to assist in creating the proper tension to the structure. For example, the simplest tensioning apparatus is the camper. However, other tensioning apparatuses are contemplated, such as winches and knobs that when turned will shorten or lengthen the tensile member, thus creating more tension or less tension. The invention can also include sensors to monitor the compression and/or tension members in order to ascertain the shape of the deployed structure and thereby provide appropriate feedback for ascertaining the state of the structure and/or manipulating the tension members and articulating the compression elements to resume a desired shape for the structure following a disturbance force.

In yet another general aspect, the invention can be a lightweight, deployable structure whose shape can be precisely monitored and controlled to acquire a wide variety of shapes and varying levels of stiffness, yet is also capable of large displacements and sustaining high loads. As such, the structure is highly suitable for use in applications in which information concerning the shape and/or stiffness of the structure can be employed to precisely attain a desired shape, precisely return the structure to a desired shape after being subjected to a disturbance force, or to increase or decrease the structural stiffness in response to changing environmental conditions.

In yet another general aspect, a deployable structure of this invention is generally composed of one or more structural units, each of which is generally a tensegrity structure. As such, each structural unit can be articulated between two extreme configurations, one of which will be termed the deployed configuration in which the deployable structure is fully extended. In one deployed configuration, each structural unit defines opposing first and second polygon-shaped ends and a polygon-shaped midsection. The first and second polygon-shaped ends each have "X" number of corners, while the midsection has "2X" number of corners so as to establish at the perimeter of the midsection "X" number of odd-numbered corners alternating with "X" number of even-numbered corners. Each structural unit is configured such that the odd-numbered corners of the midsection correspond with the corners of the first polygon-shaped end, and the even-numbered corners of the midsection corresponding with the corners of the second polygon-shaped end.

The corners of the polygon-shaped ends and the midsection of each structural unit are established by rigid compression elements that are interconnected by elastic tension members to form two interconnected tiers. The compression and tension members are interconnected such that the compression elements are subjected to essentially axial loads—i.e., essentially no bending loads are imposed on the compression elements. The shape of the structural unit is controlled by loosening and tightening the tension members and/or shortening and lengthening the compression elements. The number of compression and tension members and the manner in which the compression and/or tension members are manipulated enable the deployable structure to acquire a variety of shapes and levels of stiffness or rigidity. Multiple structural units can be interconnected through the use of both compression elements and tension members in order to promote the stiffness of the deployable structure, or alternatively solely with tension members so as to achieve maximum maneuverability and control of the deployable structure.

Importantly, the deployable structure of this invention further includes one or more articulators for manipulating the compression and/or tension members in order to articulate the deployable structure between a retracted or collapsed configuration and the aforementioned deployed configurations, or any desired intermediate configuration. In addition, the deployable structure includes sensors for detecting the status of the deployed structure by detecting the condition at one or more of the compression and/or tension members, with feedback being communicated to the articulators in order to acquire or re-acquire a desired shape or stiffness for the deployable structure. Because the compression elements sustain only compression loads, the difficulty with which bending loads are analyzed is avoided, enabling reliable closed loop control of the deployable structure.

In view of the above, it can be seen that the deployable structure of this invention provides advantages generally associated with deployable structures. Such advantages include improved efficiency because the deployable structure can be entirely assembled during manufacture or in the field. The design performance can be improved because greater precision can typically be attained for units assembled during manufacture as compared to those requiring field assembly. Another advantage is that lower transportation costs are made possible, since the deployable structure is collapsible and, therefore, is made more compact for storage and shipping. In addition, large displacements and high loads can be sustained and a significant level of vibration isolation can be achieved because the deployable structure is composed of rigid compression elements interconnected with elastic tension members.

Furthermore, considerable precision of the deployable structure's shape can be achieved through appropriate sensing of the compression and tension members to provide feedback that forms the basis for selectively and precisely altering the compression and/or tension members. Such capabilities enable the deployable structure to perform as a sensing device in which the compression and/or tension members are closely monitored in order to ascertain the shape or stiffness of the deployed structure in response to an external disturbance force, as well as reestablish a desired shape or stiffness for the structure after being subjected to a disturbance force. Alternatively, such capabilities enable the deployable structure to perform as an actuator in which the compression and/or tension members are selectively manipulated in order to retract and partially or fully deploy the structure.

Other objects and advantages of this invention will be better appreciated from the following detailed description.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

The present invention utilizes compression elements maintained in static equilibrium by one or a number of tension members, such that the compression elements do not touch each other, to provide a portable, collapsible shelter.

Figure 1:
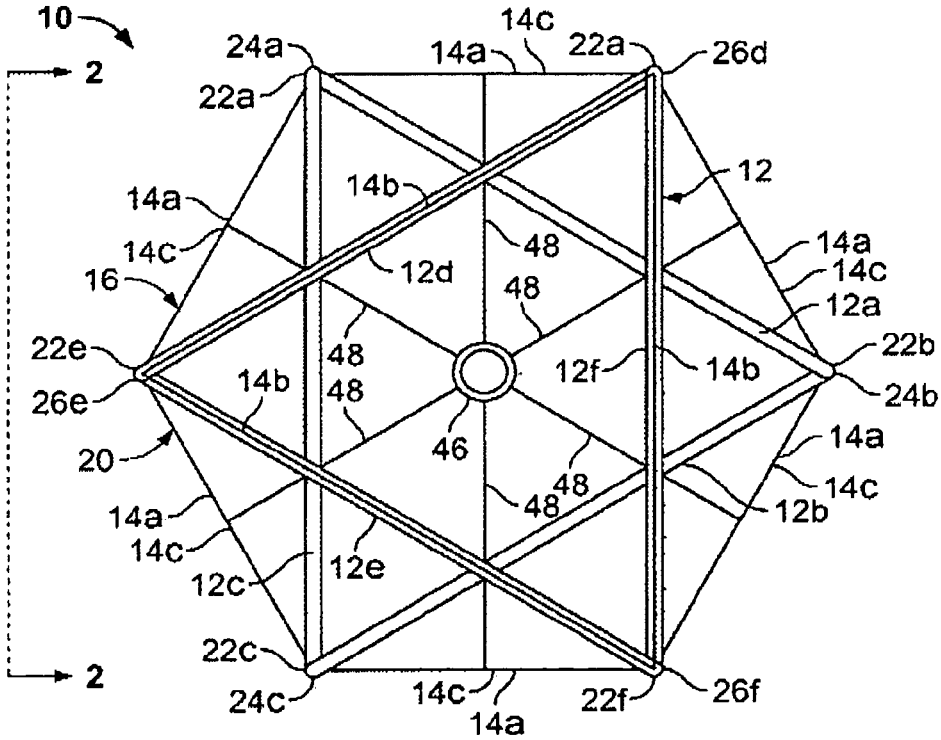
FIG. 1 is a plan view of a single structural unit of a deployable structure in accordance with a preferred embodiment of this invention.
Figure 2:
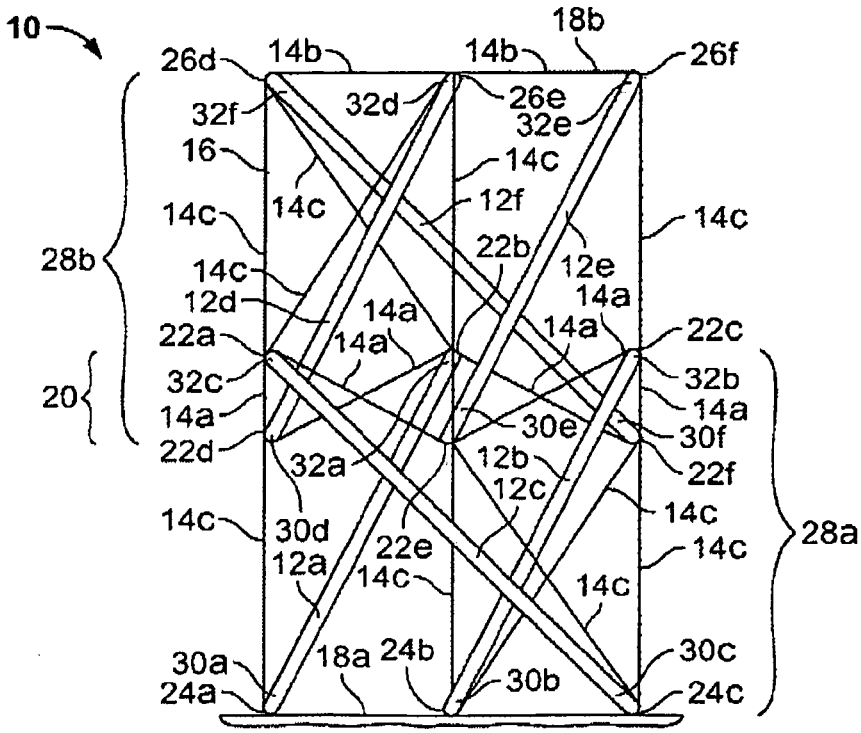
FIG. 2 is a side view of the structural unit of FIG. 1 taken along line 2-2.
Figure 3:
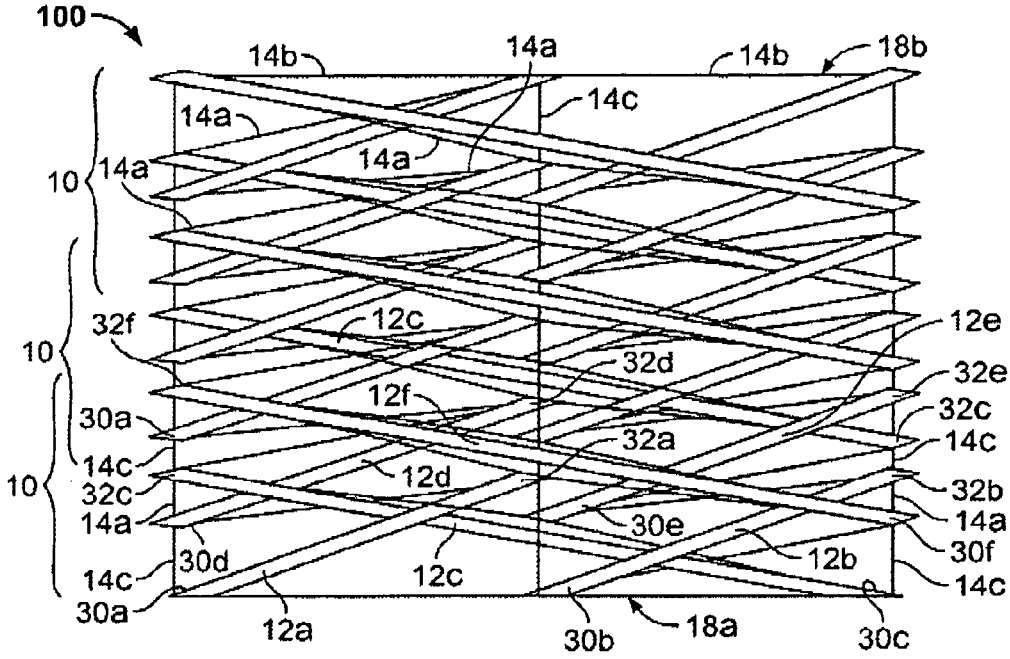
FIG. 3 is a side view of a deployable structure incorporating multiple structural units of the type shown in FIG. 1 in accordance with a first embodiment of this invention.
Figure 4:
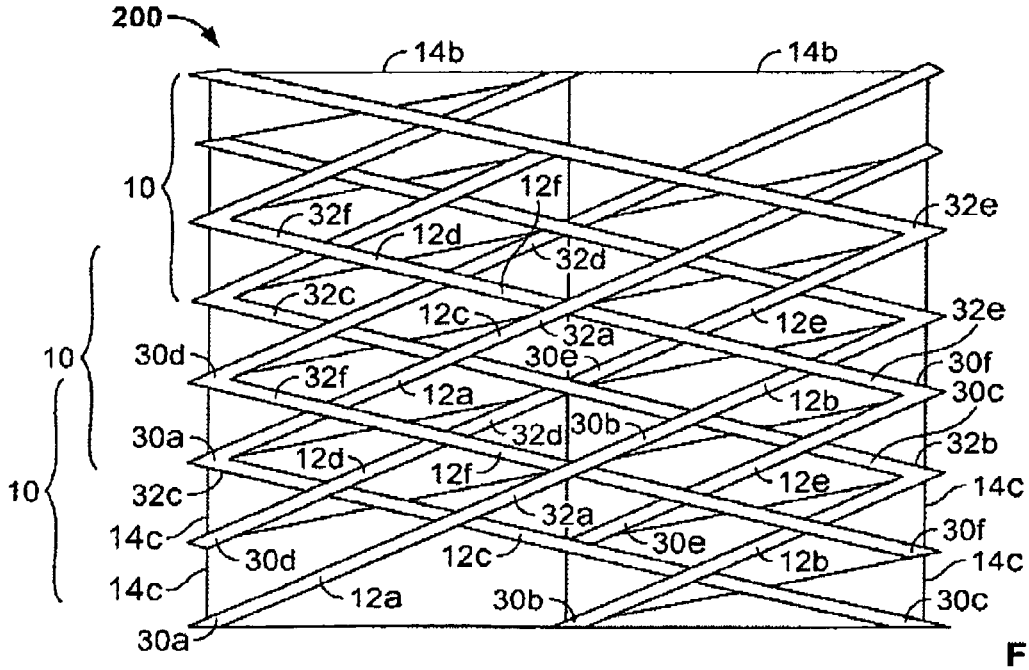
FIG. 4 is a side view of a deployable structure incorporating multiple structural units of the type shown in FIG. 1 in accordance with a second embodiment of this invention.

As a general matter, a deployable structure and a single structural unit 10 is shown in FIGS. 1 and 2. Shown in FIGS. 1 and 2 are a plan and side view, respectively, of the structural unit 10, while FIGS. 3 and 4 illustrate deployable structures 100 and 200 that incorporate a plurality of the structural units 10. As shown in FIGS. 1 and 2, the structural unit 10 is generally composed of multiple rigid compression elements, or struts 12, interconnected with elastic tension members, or tendons 14. As used herein, the term "rigid" indicates that the struts 12 do not flex or elastically deform readily in order to sustain an axial compression load with bending, while the term "elastic" indicates that the tendons 14 elastically deform when subjected to an axial tensile load, and will return to their pre-stressed condition once the load is removed. As those skilled in the art will appreciate, a wide variety of materials can be used for the struts and tendons 12 and 14. Though six struts 12*a*-12*f* are shown, it will become apparent that greater numbers of struts 12 could be employed within a given structural unit configured in accordance with the invention. In addition, though the struts 12*a*-12*f* are shown to be of approximately equal length, their lengths could differ considerably to yield a structural unit 10 appearing substantially different from that shown in the Figures.

FIG. 1 is useful to illustrate the polygonal shape of the structural unit 10 when viewed from one of its longitudinal end. The unit 10 is shown deployed in FIG. 2, in which the outline of the unit 10 defines an operating envelope 16 having a polygonal shape when as viewed in FIG. 1. Though shown as a regular hexagon in the Figures, the envelope 16 could have any even number of sides, which may be of different lengths. The hexagonal-shaped envelope 16 shown in the Figures is characterized by opposing first and second triangular-shaped ends 18*a* and 18*b*, each defining three corners 24*a*-24*c* and 26*d*-26*f*, respectively. The envelope 16 further has a midsection 20 having a polygonal shape (when viewed from the longitudinal end of the unit 10) with twice as many corners as the first and second ends 18*a* and 18*b*—here, a hexagonal shape defining six corners identified as 22*a*-22*f*. As viewed in FIG. 1, each of the corners 22*a*-22*c* is superimposed with a corresponding one of the corners 24*a*-24*c* of the first end 18*a* and a corresponding one of the corners 26*d*-26*f* of the second end 18*b*. It will be useful to describe the midsection 20 as having at its perimeter a number of "odd" corners 22*a*-22*c* alternating with an identical number of "even" corners 22*d*-22*f*, with corresponding nomenclature being used for the corners 24*a*-24*c* and 26*d*-26*f*, respectively.

As is apparent from FIG. 2, the struts 12*a*-12*c* form a first tier 28*a* of the structural unit 10, while the struts 12*d*-12*f* form a second tier 28*b* of the unit 10. Though the struts 12*a*-12*c* and 12*d*-12*f* within each tier 28*a* and 28*b* are shown to be all of the same length, the struts of different tiers and within each tier could have different lengths. Each of the struts 12*a*-12*c* has a first end 30*a*-30*c* and an oppositely-disposed second end 32*a*-32*c*, with the first ends 30*a*-30*c* being located at the odd corners 24*a*-24*c* of the first end 18*a* of the envelope 16. With reference to both FIGS. 1 and 2, it can also be seen that each of the second ends 32*a*-32*c* of the struts 12*a*-12*c* is disposed at one of the odd corners 22*a*-22*c* of the midsection 20, but not the same odd corner 22*a*-22*c* as its corresponding first end 30*a*-30*c*. In other words, each of the struts 12*a*-12*c* is inclined, such that their respective second ends 32*a*-32*c* are indexed to the next odd corner 22*a*-22*c* of the midsection 20. As shown, the second end 32*a* of the strut 12*a* is disposed at the odd corner 22*b*, the second end 32*b* of the strut 12*b* is disposed at the odd corner 22*c*, and the second end 32*c* of the strut 12*c* is disposed at the odd corner 22*a*. Though FIG. 2 shows the struts 12*a*-12*c* as being inclined in a counterclockwise direction, they could alternatively have been shown inclined in a clockwise direction. As is apparent from FIG. 2, the second ends 32*a*-32*c* of the struts 12*a*-12*c* are shown as being disposed in a plane displaced above the first end 18*a* of the envelope 16.

In a manner similar to that described for the struts 12*a*-12*c*, the struts 12*d*-12*f* are also arranged in the second tier 28*b* of the structural unit 10 to have their first ends 30*d*-30*f* located at different even corners 22*d*-22*f* of the midsection 20. Specifically, the first end 30*d* of the strut 12*d* is disposed at the even corner 22*d*, the first end 30*e* of the strut 12*e* is disposed at the even corner 22*e*, and the first end 30*f* of the strut 12*f* is disposed at the even corner 22*f*. Furthermore, the second ends 32*d*-32*f* of the struts 12*d*-12*f* are located at one of the even corners 26*d*-26*f* of the second end 18*b* corresponding to a different even corner 22*d*-22*f* from that of their corresponding first ends 30*d*-30*f*. Specifically, the second end 32*d* of the strut 12*d* is disposed at the even corner 26*e*, the second end 32*e* of the strut 12*e* is disposed at the even corner 26*f*, and the second end 32*f* of the strut 12*f* is disposed at the even corner 26*d*.

As apparent from FIGS. 1 and 2, each of the first ends 30*d*-30*f* of the struts 12*d*-12*f* is disposed between two adjacent second ends 32*a*-32*c* of the struts 12*a*-12*c* of the first tier 28*a*. In the embodiment of FIG. 2, the first ends 30*d*-30*f* of the struts 12*d*-12*f* are disposed in a second plane that is parallel to the plane containing the second ends 32*a*-32*c* of the struts 12*a*-12*c*, though these two planes need not be parallel. Importantly, the plane containing the first ends 30*d*-30*f* of the struts 12*d*-12*f* is disposed beneath the plane containing the second ends 32*a*-32*c* of the struts 12*a*-12*c*. In essence, the first ends 30*d*-30*f* are cradled by the tendons 14*a* between the second ends 32*a*-32*c*. According to the invention, the plane defined by the first ends 30*d*-30*f* must lie below the plane defined by the second ends 32*a*-32*c* in order for the unit 10 to be structurally stable, i.e., exhibit static equilibrium As such, the polygonal shape of the midsection 20 cannot lie in a single plane, but instead will be skewed in some manner, as is depicted in FIGS. 2, 3, 4 and 6. FIG. 4 depicts the plane defined by the first ends 30*d*-30*f* as being disposed approximately half the distance between the plane defined by the second ends 32*a*-32*c* and the first end 18*a* of the structural unit 10. The different characteristics of the arrangements shown in FIGS. 3 and 4 will be discussed in greater detail below.

With reference again to FIGS. 1 and 2, the structural unit 10 is shown to include six tendons 14*a*, each of which interconnects one of the second ends 32*a*-32*c* of the struts 12*a*-12*c* with an adjacent one of the first ends 30*d*-30*f* of the struts 12*d*-12*f*. Furthermore, the second ends 32*d*-32*f* of the struts 12*d*-12*f* are interconnected with three tendons 14*b*, and additional tendons 14*c* further interconnect the struts 12*a*-12*c* with the struts 12*d*-12*f*. Specifically, the tendons 14*c* are employed to interconnect:

(a) the first end 30*a* of the strut 12*a* with the first end 30*d* and the second end 32*c;*

(b) the first end 30*b* of the strut 12*b* with the first end 30*f* and the second end 32*a;*

(c) the first end 30*c* of the strut 12*c* with the first end 30*e* and the second end 32*b;*

(d) the first end 30*d* of the strut 12*d* with the second end 32*f;*

(e) the first end 30*e* of the strut 12*e* with the second end 32*d;*

(f) the first end 30*f* of the strut 12*f* with the second end 32*e;*

(g) the second end 32*a* of the strut 12*a* with the second end 32*f;*

(h) the second end 32*b* of the strut 12*b* with the second end 32*f*; and (i) the second end 32*c* of the strut 12*c* with the second end 32*d*.

As shown in FIG. 1 (but omitted from FIGS. 2 through 6 for clarity), each of the tendons 14*a* are capable of being manipulated to alter their tension so as to selectively articulate the structural unit 10 between its retracted and deployed configurations, as well as any intermediate configuration therebetween. The structural unit 10 of FIG. 1 is shown as being equipped with a centrally-disposed shaft 46 that is rotatably supported relative to the unit 10. The shaft 46 is interconnected to each of the tendons 14*a* with an appropriate number of tendons 48 or other suitable members, which serve to draw the tendons 14*a* toward the shaft 46 is rotated, resulting in an increase in the tension within the tendons 14*a*. In this manner, the tension in the tendons 14*a* can be selectively increased or decreased in order to articulate the structural unit 10 between its deployed and stowed configurations, or to control the rigidity (stiffness) of the unit 10 after deployment.

While a shaft and tendons are illustrated, numerous other techniques for altering the tension in the tendons 14*a* will be apparent to one skilled in the art, and such techniques are within the scope of this invention. Alternatively, one or more of the struts 12*a*-12*f* shown in the Figures can have a telescoping design that enables the struts 12*a*-12*f* to be extended and retracted electrically, mechanically, pneumatically or hydraulically. As such, if the tension in the tendons 14 is increased and/or the struts 12*a*-12*f* are extended, the structural unit 10 is extended to acquire its deployed configuration, characterized by the shape of the envelope 16. In contrast, if the tension in the tendons 14 is decreased and/or the struts 12*a*-12*f* are retracted, the structural unit 10 is collapsed to acquire a stowed or collapsed configuration. Finally, if only a select few of the tendons 14 or struts 12*a*-12*f* are altered, the shape of the structural unit 10 can be uniquely altered from that shown in the Figures.

Figure 5:
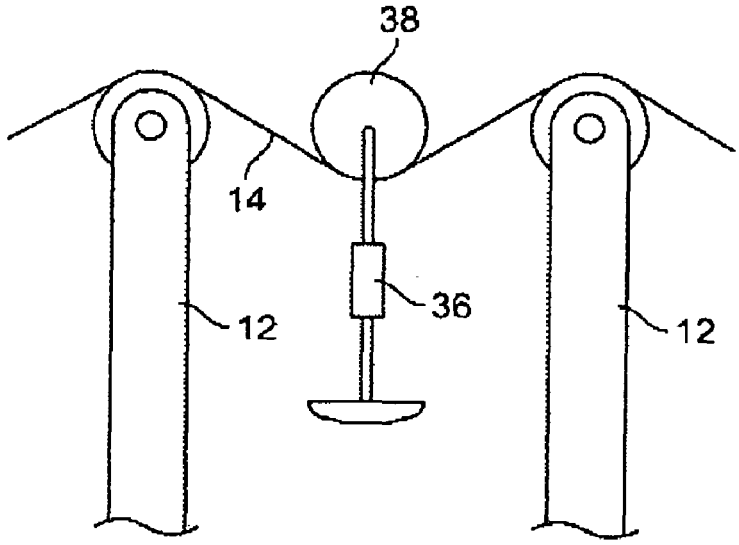
FIG. 5 shows a tension adjusting and measuring device that can be used with the structural unit of FIG. 1 in accordance with one aspect of this invention.

According to this invention, the ability to deploy and stow the structural unit 10 shown in FIGS. 1 and 2 is useful when coupled with a system that enables the shape and/or stiffness of the unit 10 to be accurately detected, and then provides feedback to the struts and/or tendons 12 and 14 in order to enable the unit 10 to alter its configuration or stiffness, or to reestablish a desired configuration or stiffness. The manner in which the configuration of the unit 10 is sensed can be through sensing the tension in at least some of the tendons 14 and/or the compression or length of the struts 12. FIG. 5 schematically represents one such embodiment, in which the tension in a tendon 14 is detected by a piezoelectric strain gauge 36 equipped with a roller 38 and placed between any adjacent two of the struts 12. Those skilled in the art will appreciate that alternative methods and devices for measuring stress or strain in the tendons 14 and/or the struts 12 could be employed, and all such methods and devices are within the scope of this invention.

Turning now to FIGS. 3 and 4, multiple units 10 are shown as being assembled to form deployable structures 100 and 200. The deployable structure 100 of FIG. 3 illustrates a configuration in which the plane containing the first ends 30*d*-30*f* of the struts 12*d*-12*f* is disposed beneath the plane containing the second ends 32*a*-32*c* of the struts 12*a*-12*c*, and less than half the distance between the latter plane and the first end 18*a* of the structure 100. As shown in FIG. 3, such an arrangement of units 10 results in each unit 10 being interconnected with its adjacent units 10 with only a set of the tendons 14*c*. For example, the second end 32*c* of the strut 12*c* of the bottom unit 10 is interconnected with a tendon 14*c* to the first end 30*a* of the strut 12*a* of the second unit 10, and the second end 32*b* of the strut 12*b* of the bottom unit 10 is interconnected with a tendon 14*c* to the first end 30*c* of the strut 12*c* of the second unit 10 As such, the units 10 are vibrationally isolated from each other, such that the deployable structure 100 resists transmission of vibrations between its upper and lower ends 18*a* and 18*b*. In addition, the maneuverability of the structure 100 is maximized, providing a maximum degree of freedom for the units 10. As such, the deployable structure 100 is of the type most suited for dynamic structures such as payload pointing structures, vibration isolation of machinery, antennas, equipment that must be compactly stowed for transport to space, and robotic members.

In contrast, FIG. 4 depicts the plane containing the first ends 30*d*-30*f* of the struts 12*d*-12*f* as being disposed approximately half the distance between the plane containing the second ends 32*a*-32*c* of the struts 12*a*-12*c* and the first end 18*a* of the structure 200. As a result, the second ends 32*a*-32*c* of the struts 12*a*-12*c* are shown as contacting the first ends 30*a*-30*c* of the struts 12*a*-12*c* of the adjacent unit 10, instead of being interconnected with tendons as shown for the embodiment of FIG. 3. Preferably, the ends 30*a*-30*c* and 32*a*-32*c* are pivotably connected. In this manner, the deployable structure 200 is capable of being deployed and collapsed in essentially the same manner as the structure 100 of FIG. 3, but is characterized by greater stiffness. As such, the deployable structure 200 is of the type most suited for such structures as buildings, bridges, support platforms for space telescopes and antennae, and airfoils for aerospace applications. In particular, this invention is highly suitable to form the support structure for an airfoil, wherein the selective control of the shape and stiffness of the structural unit 10 enables the airfoil to be selectively and precisely altered in order to affect its aerodynamics.

Figure 6:
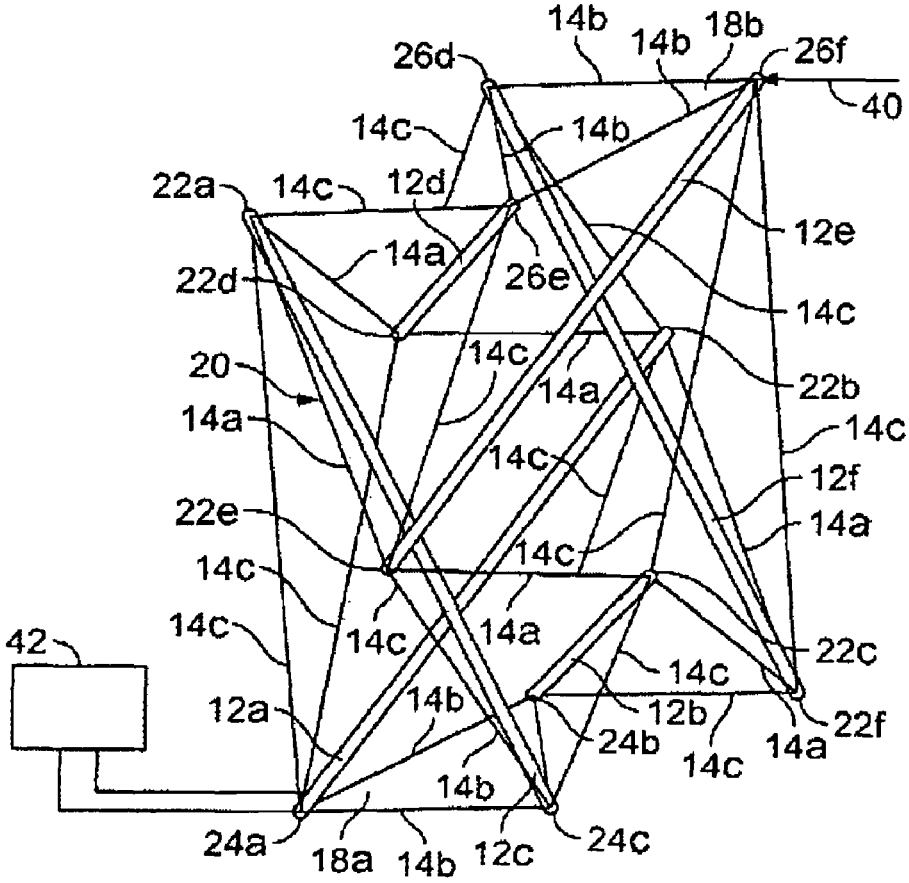
FIG. 6 is a schematic representation of a sensing structure incorporating the structural unit of FIG. 1.

With either arrangement depicted in FIGS. 3 and 4, a deployable structure in accordance with this invention must be operative to enable the shape and/or stiffness of its units 10, individually or in unison, to be altered in order to achieve precise articulation of the deployable structure or achieve a desired level of stiffness for the structure. Such a capability can be advantageously exploited if the deployable structure is used as an actuator to precisely position a payload or a sensor that can respond to an external disturbance force to counteract the force or otherwise accommodate the force such that the desired shape and/or stiffness of the structure are not adversely affected. One such example is represented in FIG. 6, in which a deployable structure 300 incorporating the single structural unit 10 of FIG. 1 is adapted to respond to a disturbance force 40 applied to one of the corners 26*f* of the structure 300. Shown schematically is a feedback control 42 for communicating the output of sensors (not shown) coupled with one or more of the tendons 14, to a mechanism (not shown) for altering the tension in the tendons 14 and/or the lengths of one or more of the struts 12*a*-12*f*, so as to articulate the structure 300 in response to changes in the tension of the tendons 14 as a result of the disturbance force 40. If the structure 300 is a building, such that the struts 12 and tendons 14 are beams and cables, respectively, within the building, examples of potential disturbances to the structure 300 include high winds and earthquakes. Through monitoring the output of the sensors coupled with the tendons 14, whose output will change as a result of the structure's configuration being forcibly altered by the disturbance force 40, rapid compensation can be made in the tension within selected tendons 14 in order to counteract the disturbance and thereby appropriately modify the stiffness of the structure 300, reestablish the original configuration of the structure 300, or possibly reconfigure the structure 300 in order to attain a configuration better adapted to the new environment of the structure 300 or more readily capable of withstanding the disturbance.

The dynamics of the structural unit 10 or any of the deployable structures 100, 200 and 300 of this invention are complex and therefore not obvious to one skilled in the art. However, this difficulty is overcome by the availability of software, such as DYCOM available from Dynamic Engineering Company, Inc., of Palm Harbor, Fla., which develops equations of motion that are able to reliably model the structural unit 10 and deployable structures 100, 200 and 300 of this invention due to their construction—namely, the struts 12 and tendons 14 undergo only axial forces, such that the extreme difficulty of accurately modeling bending moments is completely avoided. Consequently, the simplicity of the axial forces within the structural unit 10 enables reliable modeling, and therefore reliable control of the struts 12 and/or tendons 14 through the use of analytical determinations using the feedback control 42.

Figure 7:
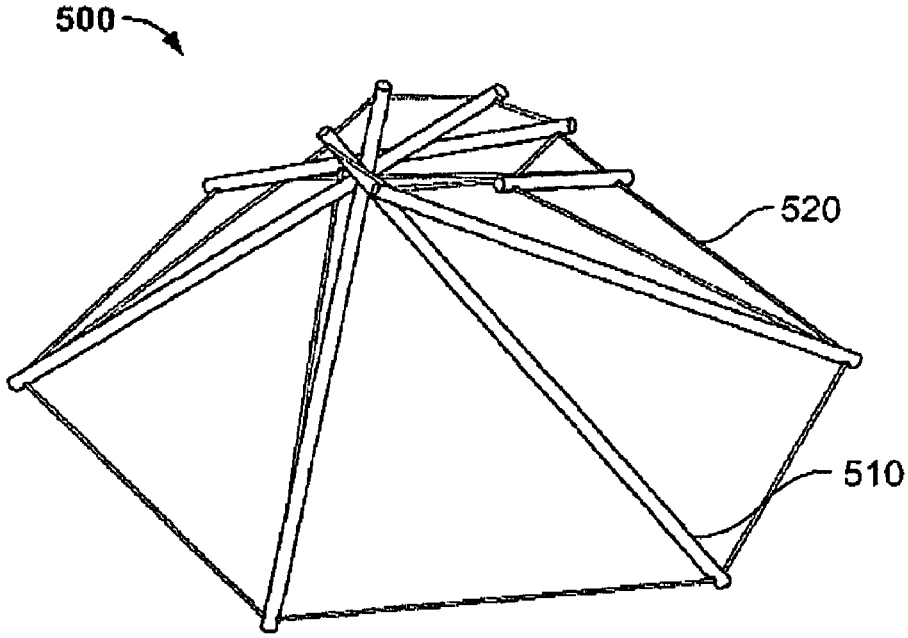
FIG. 7 depicts one embodiment of the present invention.
Figure 8:
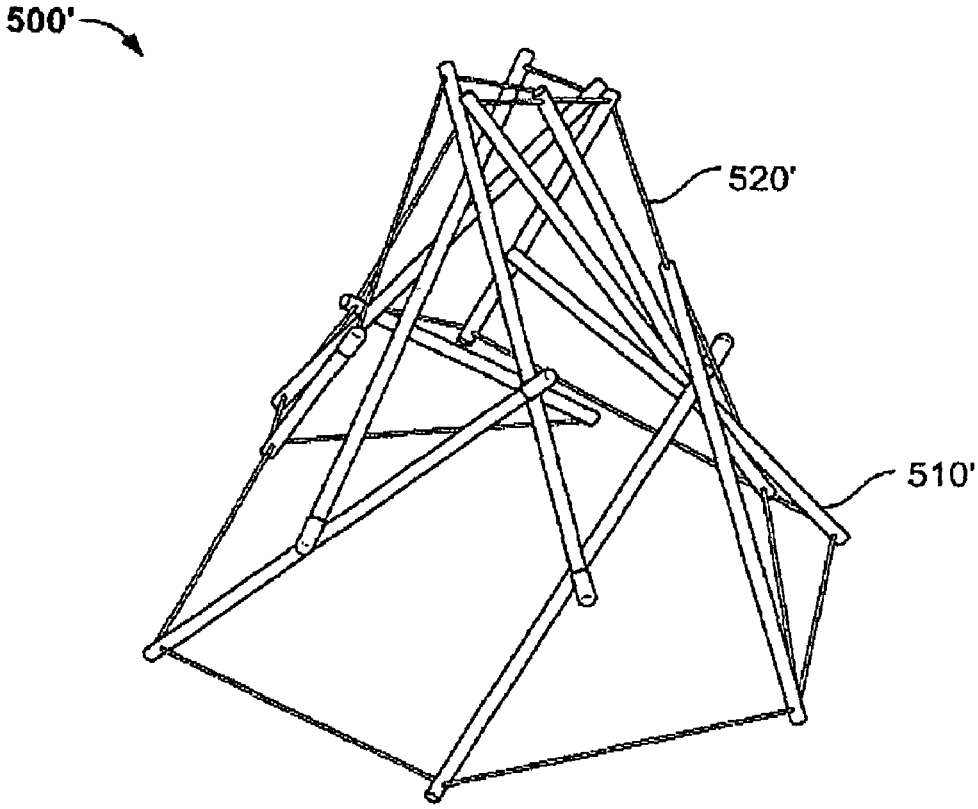
FIG. 8 depicts one embodiment of the present invention.
Figure 9:
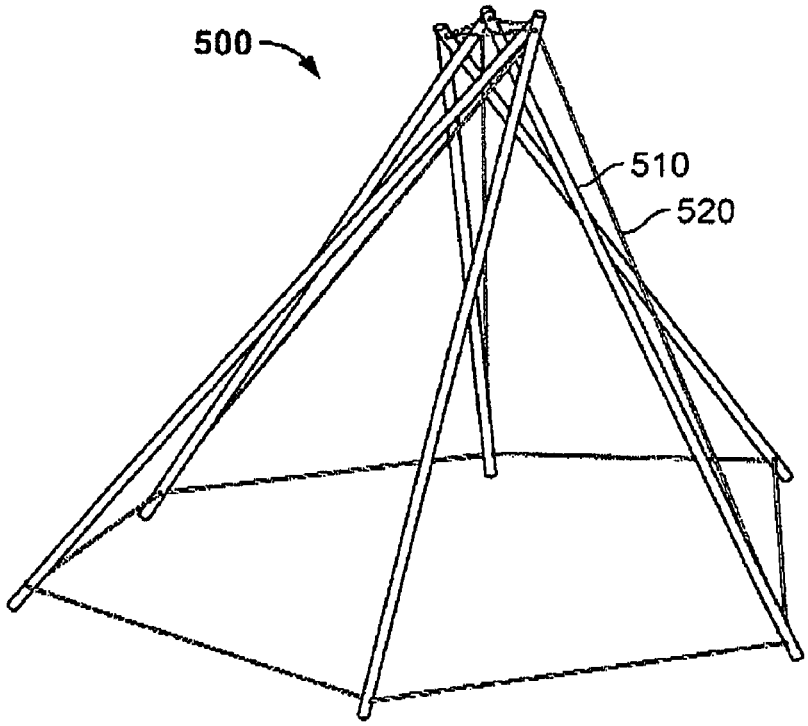
FIG. 9 depicts one embodiment of the present invention.
Figure 10:
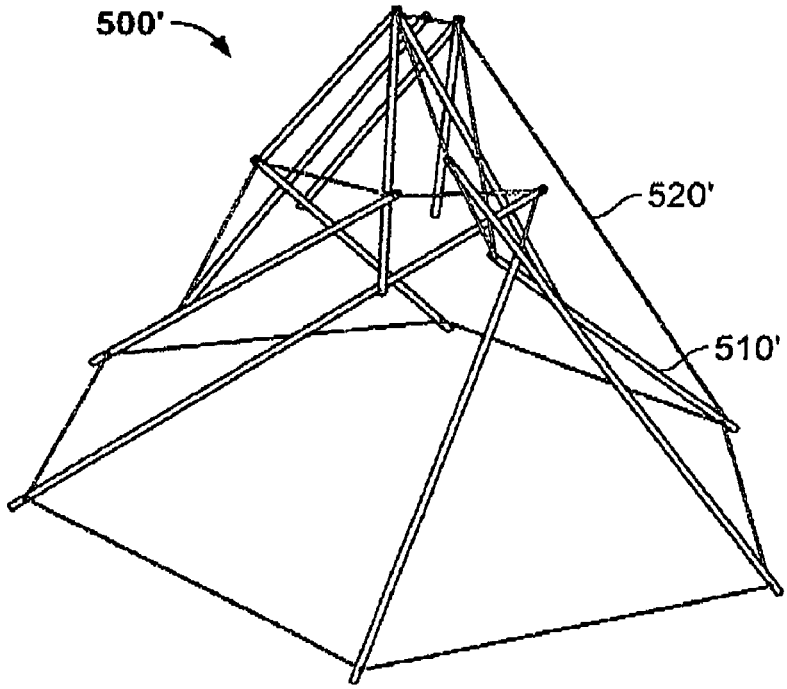
FIG. 10 depicts one embodiment of the present invention.
Figure 11:
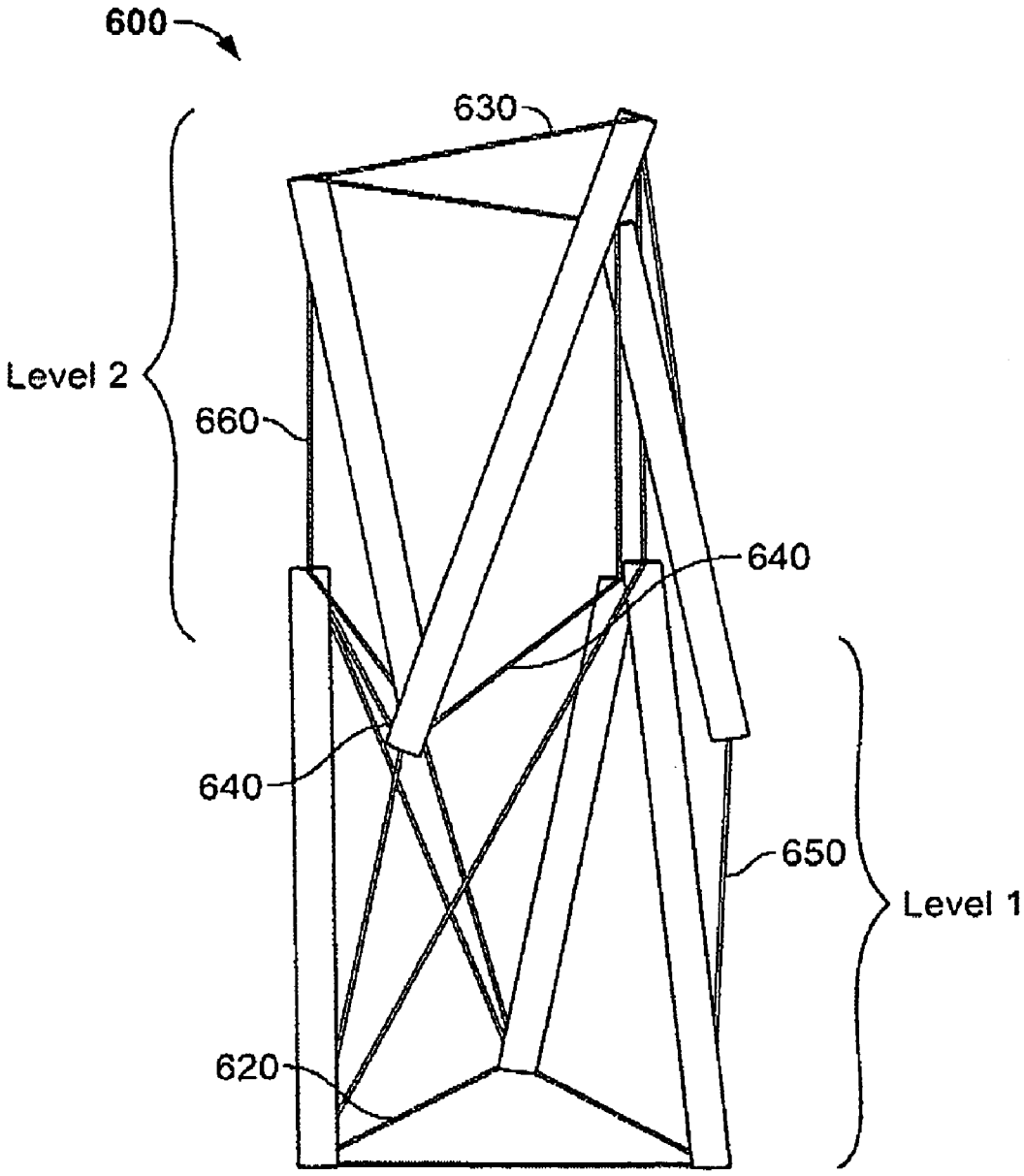
FIG. 11 depicts a diagram showing the components of one embodiment of the present invention.

Utilizing these general concepts, the present invention includes a portable, collapsible shelter. FIGS. 7 and 8 show models of the structure of a single-stage tent 500 according to one exemplary embodiment of the invention. The structure has compression elements 510 and tensile members 520. FIGS. 9 and 10 show models of the structure of a double-stage tent 500' according to another exemplary embodiment of the invention. The double-stage structure also has compression elements 510' and tensile members 520'. FIG. 11 depicts a more detailed diagram of a double-stage structure 600. Horizontal tensile members connect the compression elements 610 at the top portion or the bottom portion of the compression elements, e.g., the base 620, top 630, and saddle 640 strings. At the first stage, vertical tensile members 650 connect the top portion of a compression element 610 to the bottom portion of another compression element 610. At the second stage, vertical tensile members 660 connect the top portion of a compression element 610 to the bottom portion of another compression element 610.

Figure 12:
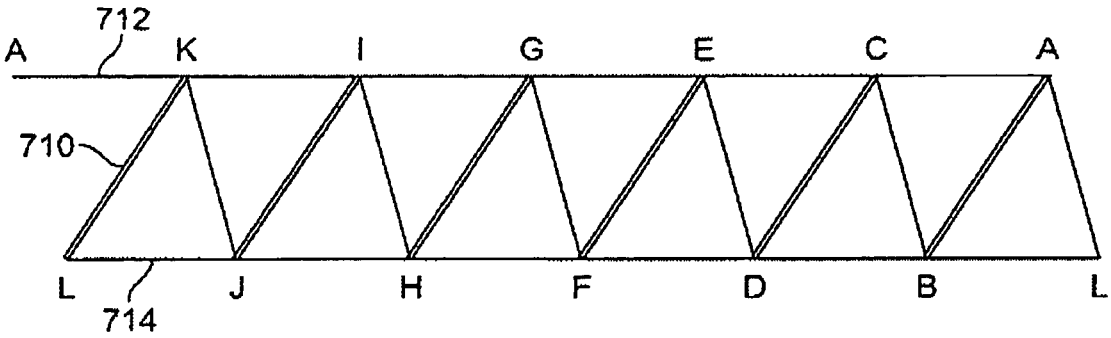
FIG. 12 depicts a schematic of one embodiment of the invention.

FIG. 12 shows a schematic of one embodiment of a single-stage tent. The tent has six compression elements 710. A horizontal tensile member(s) 712 connects the ends of the compression elements 710 at points A to K, K to I, I to G, G to E, E to C and C to A, which can arbitrarily be designated as a top end. Another horizontal tensile member(s) 714 can then connect the bottom ends of the compression element 710 at points L to J, J to H, H to F, F to D, D to B, and B to L. A vertical tensile member(s) 716 connects the ends of the compression elements at ends K to J, I to H, G to F, E to D, C to B, and A to L.

The tensile member(s) can be a single piece or multiple pieces connecting together two or more points. For example, with respect to vertical tensile members, a tensile member can connect one element to another (K to J) and another vertical tensile member connects an element to another (I to J). Alternatively or additionally, one or more compression elements can be hollow so that a tensile member can run through the element. This allows a single member to be able to connect more than two elements in series.

Figure 13:
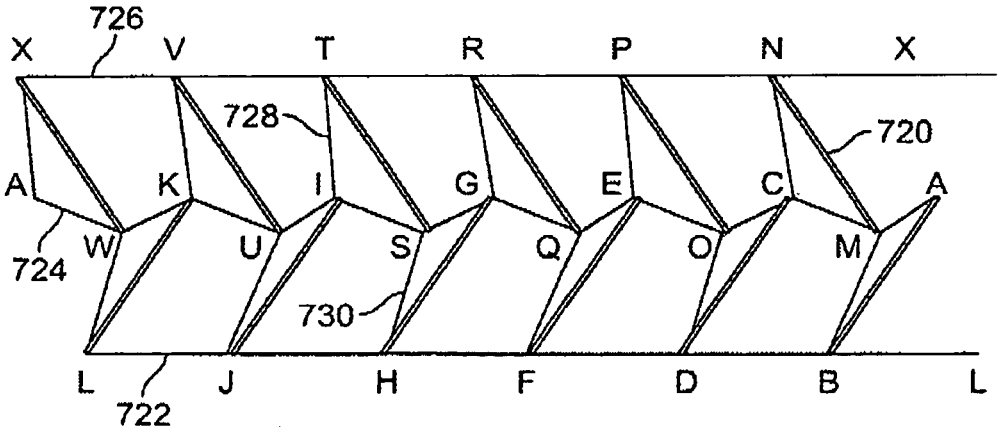
FIG. 13 depicts a schematic of one embodiment of the invention.

It should be noted that the figure of FIGS. 12 and 13, as well as others, are not drawn to scale. For example, the top tensile members are of shorter length than the bottom tensile members. This creates the tepee-like shape of the tent. The length of the tensile members as well as the length of the compression elements and the angle that the compression elements make with the ground once assembled, determines the dimensions of the element. For example, the more perpendicular the compression element is to the ground, the taller the tent. Similarly, the larger the difference in circumference between the top horizontal tensile members and the bottom tensile members, the more squat the shape of the tent. In other words, all other things being equal, the tent will be shorter but the size of the base will be greater, as the difference in circumference between the top and bottom tensile members is increased.

FIG. 13 shows a schematic of one embodiment of a double-stage tent. The tent has twelve compression elements 720. At the first stage, a horizontal tensile member(s) 722, 724 connects the ends of the compression elements, arbitrarily designated the bottom end and the top end. At the second stage, the bottom of the compression elements 720 are also connected by the horizontal tensile member 724, however each compression element of the second stage intersects the horizontal tensile member 724 at some point between where the top compression elements 720 of the first stage intersect the horizontal tensile member 724. A horizontal tensile member 726 is used to connect the top portion of the compression elements 720 at the second stage. Vertical tensile members 728, 730 are used to connect and provide support to the structure. They connect a top portion of a compression element of the first stage to a compression element of the second stage as well as connecting a bottom portion of a compression element of a first stage to a bottom portion of a compression element of the second stage. One function of the vertical tensile members is to provide tautness to the structure so that the compression elements cannot collapse into each other.

Due to the design, each component of the structure experiences only axially-loaded forces. Since the compression elements are axially-compressed, there are no other forces acting on the other axes to bend or warp them. Tensile members are tensioned and are axially-loaded as well. Tensile members increase in rigidity with the increase in tension. The equilibrium of these compression elements and the tensile members create a structure that relies solely on axial forces rather than torque to maintain its integrity.

Figure 14:
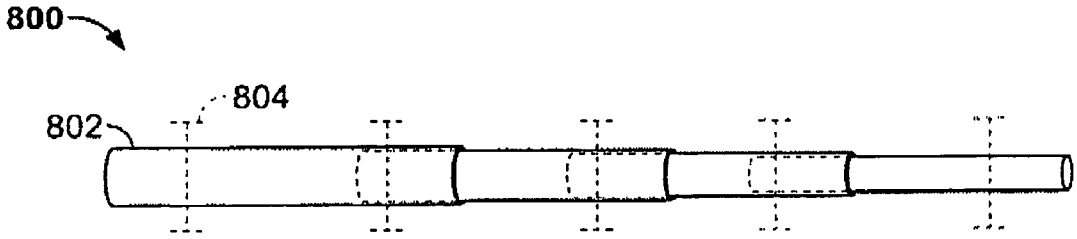
FIG. 14 depicts a compression element according to one embodiment of the invention.

Compression elements can be made of any rigid material, such as metal (e.g., steel, aluminum, titanium), fiberglass and other polymers, a natural material (e.g., wood or bamboo), or any combination thereof. A compression element can be a single solid or hollow structure. Alternatively, the compression element can be of multiple pieces. Having a single compression element be of multiple pieces allows for greater convenience in carrying around and storing the tent. FIG. 14 shows one embodiment of a telescoping element 800, with dimension for constructing a model of an exemplary tent. Segments 802 of the element 800 are fitted together and held in place by pins or screws 804. Other methods and mean of making telescoping elements include, but are not limited to, using hinges to connect the segments or using threaded ends to screw the segments together to create a usable compression element, when assembled. Another example is the use of shock-corded elements that are threaded in segments over elastic (shock) cord that allows the user to merely snap the segments into shape rather than piece them together. A compression element made of segments can also have the advantage of allowing a user to adjust the length of the compression element by adding more or less segments, as desired.

Figure 16:
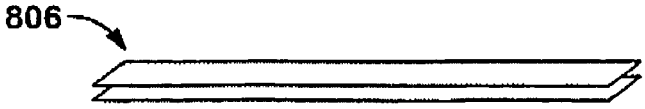
FIG. 16 depicts a string according to one embodiment of the invention.

The tensile members can be made of any man-made material (e.g., fibers and polymers such as nylon) or natural material (such as cotton or rubber), or any combination thereof. The tensile members may be elastic or non-elastic; however, the tensile members must have sufficient tensile strength to be able to be pulled taut without breaking, thus allowing the tent to maintain its shape. The tensile members can be likened to the human body where ligaments, tendons and muscles can act as tensile members to hold together the bones (compression elements) to shape the individual. FIG. 16 shows that in one embodiment, the tent of FIG. 17 has a double-layered elastic string 806 as its vertical tensile member.

Embodiments of the invention can also include a covering to completely or partially enclosed shelter. The cover can be made of a natural material, a man-made material, or a combination of both. Exemplary materials include, but are not limited to, canvas, nylon, taffeta, ripstop nylon, and polyester. Different parts of the cover may be composed of different materials depending on its function. For example, the fabric of the floor, which is tread upon and in contact with the ground, may be of a sturdier material than the roof.

Figure 15:
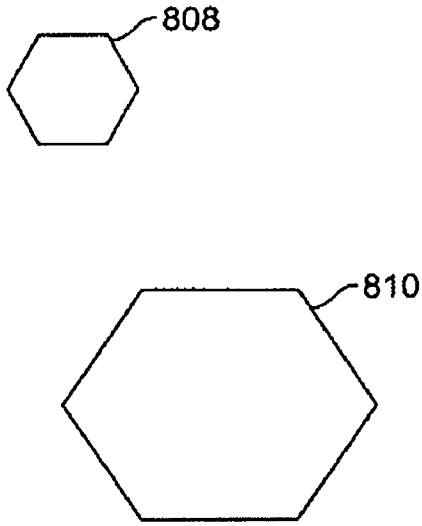
FIG. 15 depicts a roof and floor according to one embodiment of the invention.
Figure 17:
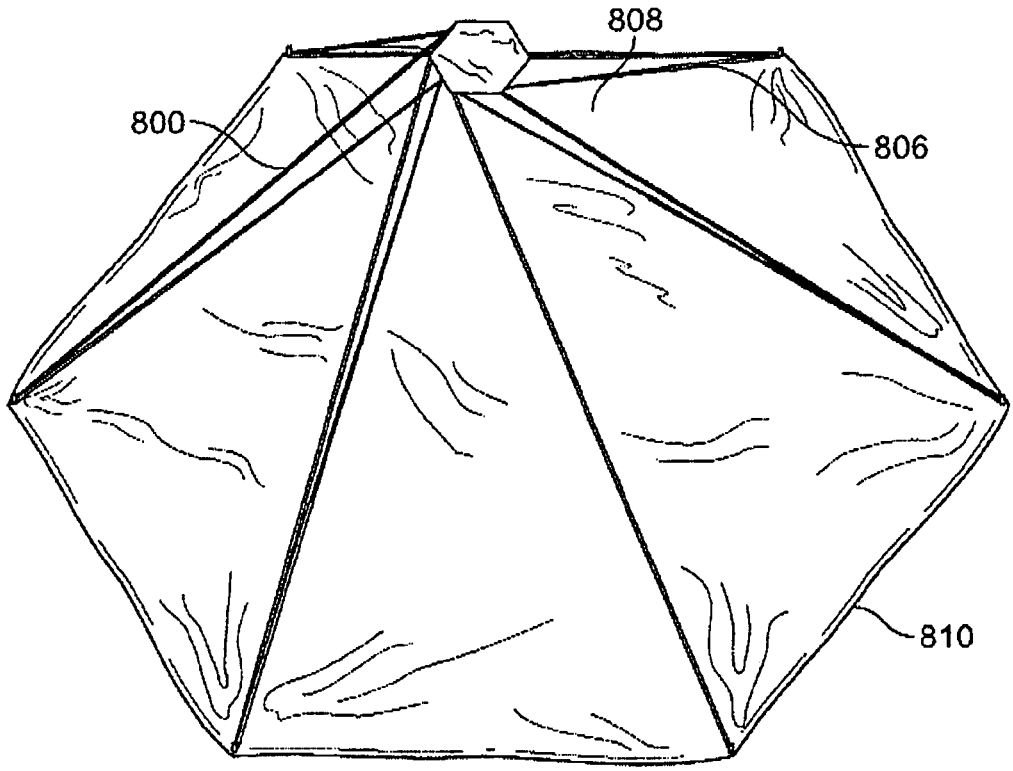
FIG. 17 depicts a tent according to one embodiment of the invention.
Figure 18:
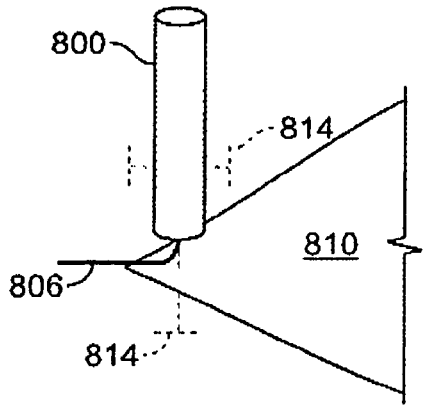
FIG. 18 depicts an attachment design according to one embodiment of the invention.

FIG. 17 shows an exemplary tent of the invention. The roof 808 and floor 810 of the tent of FIG. 17 are shown in FIG. 15, with exemplary dimensions to create a model tent. The shape of the floor 810 and/or roof 808, in most cases, will be determined by the shape of the compression elements/tensile member structure. However, it is also envisioned that the shape of the floor 810 or roof 808 can be of a different shape than that dictated by the structure. For example, the roof may be larger than the top created by the top horizontal tensile member and, thus, allow for an overlap of material from the top of the tent to the sides to allow for ventilation, yet protection from driving rain. FIG. 18 shows an exemplary means of attaching the roof or floor 810 to a compression element 800 with the use of pins 814. Other embodiments for attaching the floor or roof include, but are not limited to, the use of other fasteners, such as GRIP CLIP™ (Shelter Systems), grommets or pockets in the covering to which the compression element can be inserted.

It is not necessary for tents of the inventions to have a roof or a floor, but they can have one or both. It is further contemplated that in cases where a roof and/or a floor is used, the roof and/or floor can be used to function as the horizontal tensile members, thus eliminating the need to a separate tensile member. However, the tent of the invention may have, a roof and/or floor and horizontal tensile members.

Figure 19:
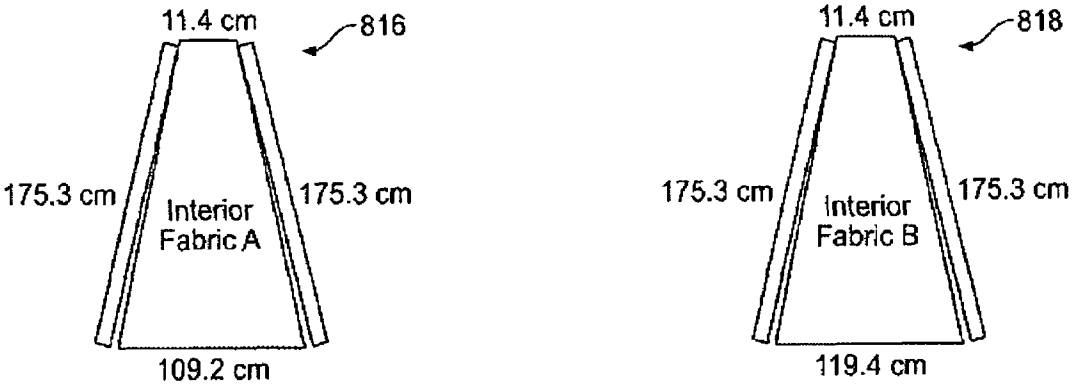
FIG. 19 depicts side panels according to one embodiment of the invention.
Figure 20:
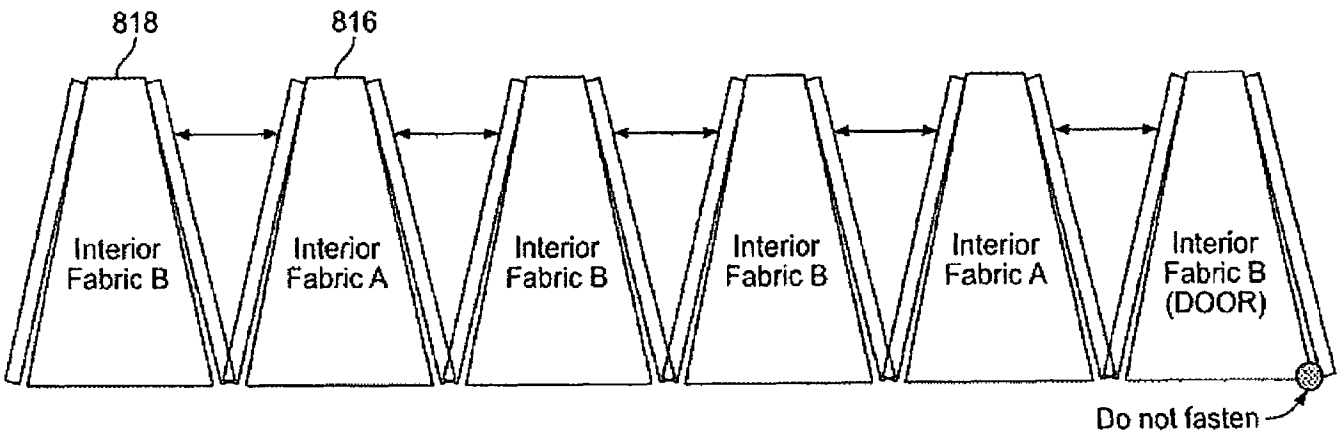
FIG. 20 depicts a sewing pattern according to one embodiment of the invention.

FIG. 19 shows an exemplary side wall 816, 818 (or panel) of the tent with dimensions for creating a model tent. The number of panels is determined by the number of compression elements. FIG. 20 shows an exemplary sewing pattern for creating the side wall of the tent. It is contemplated that the panels are sewn together as a covering to be placed over the compression elements, like a coat. However, it is also contemplated that the panels are sewn to create sleeves along the vertical length of the panels for passage of the compression elements. It is further contemplated that the panels can be hung from the compression elements.

The side panels can also eliminate the need for horizontal tensile members for tent of the invention. The function of the bottom horizontal tensile member can be fulfilled by the bottom edge of the panels. Likewise the function of the bottom horizontal tensile member can be fulfilled by the top edge of the panels. Similarly, the saddle tensile member can also be an edge of the panel.

Figure 21:
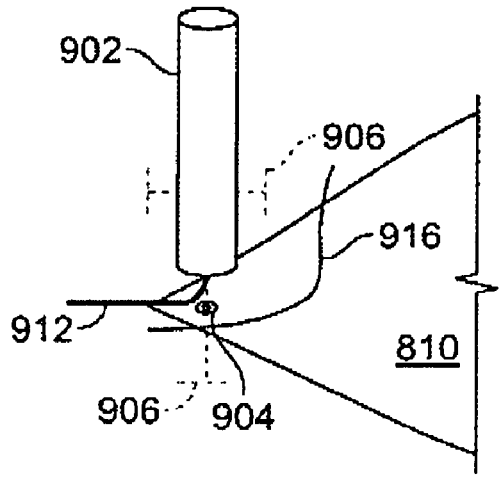
FIG. 21 depicts an attachment design according to one embodiment of the invention.
Figure 22:
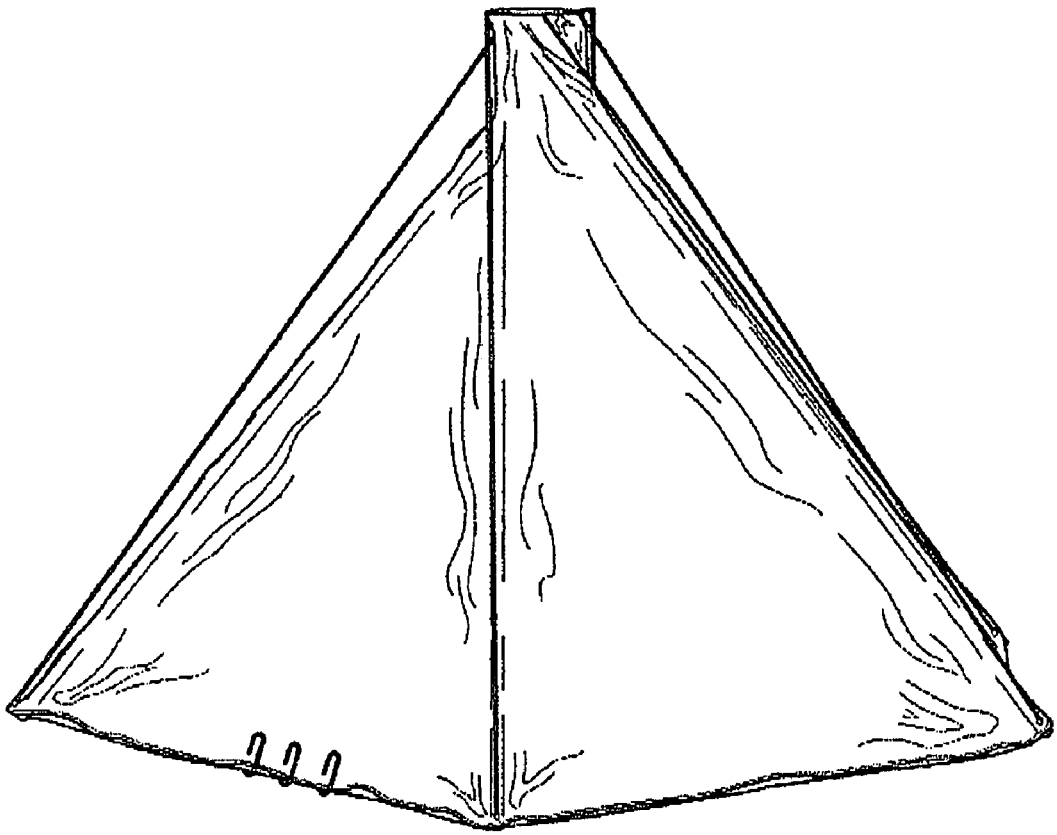
FIG. 22 depicts a tent according to one embodiment of the invention.
Figure 23:
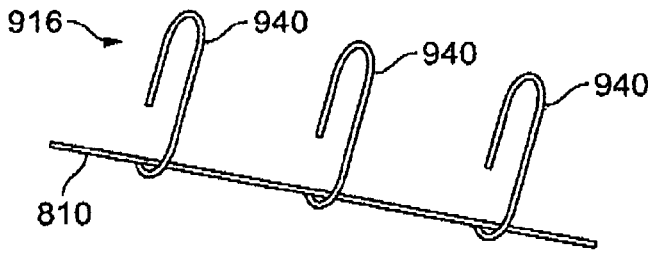
FIG. 23 depicts one method of stabilizing the interior fabrics according to one embodiment of the invention.

FIG. 21 shows the means for attaching the floor 810 and side panel 916 to the compression elements 902, through the use of grommets 904 and pins 906. Also shown is the tensile member 912. FIG. 22 depicts a model tent. FIG. 23 shows the use of clips 940 to attach the floor 810 to a side panel 916. It is further contemplated that the side panels and floor and/or roof can be of a single construction.

Figure 24:
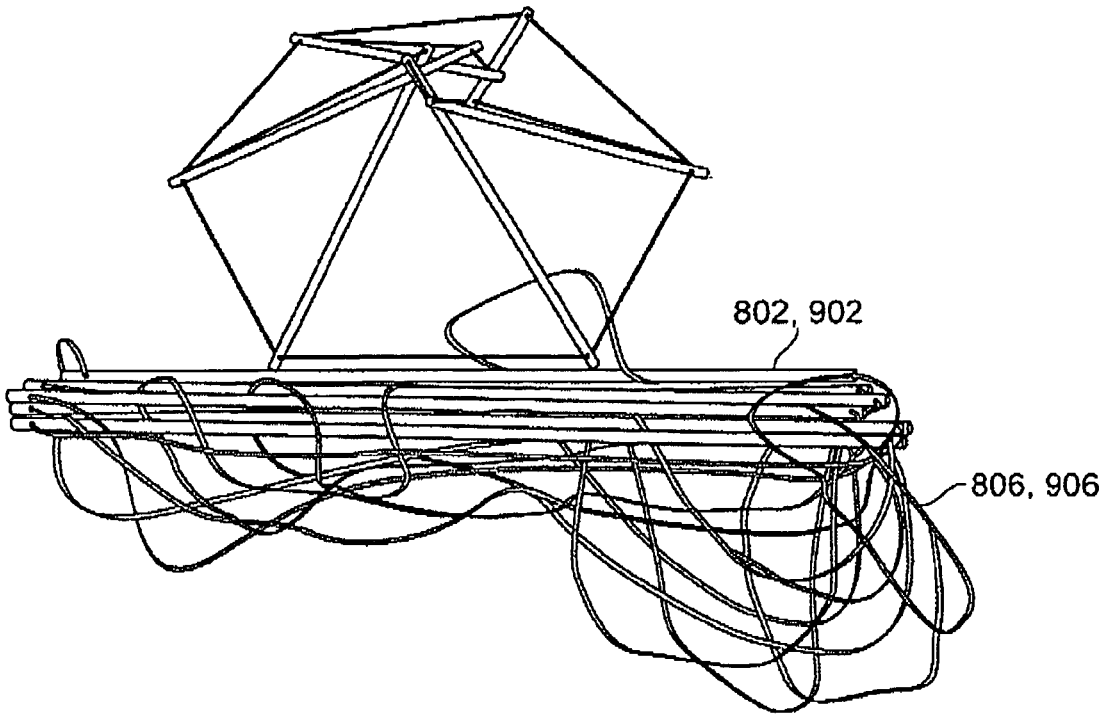
FIG. 24 depicts the compression elements and tensile members according to one embodiment of the invention.
Figure 25:
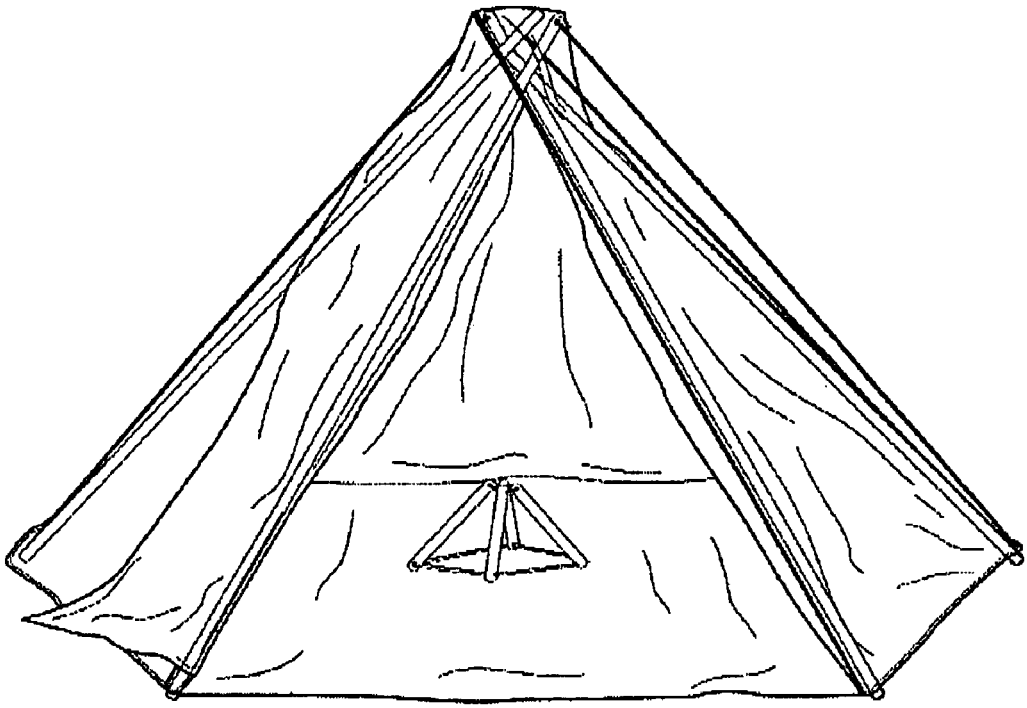
FIG. 25 depicts a tent according to one embodiment of the invention.

FIG. 24 shows the compression elements 800, 902 and tensile members 806, 912 of FIG. 22 in an undeployed stated. FIG. 25 is another view of the model tent shown in FIG. 22, with the door flap open. The invention may further include loops and stakes or other means for tying the tent to the ground.

EXAMPLE 1

In constructing the model described above one needs 12 Brass K&S Telescoping Rods (K&S Engineering, Chicago, Ill.):

- 3 of Stock #1150 (36-inch [91.44 cm] length; 9/32-inch [0.714 cm] diameter,
- 3 of Stock #1151 (36-inch [91.44 cm] length; 5/16-inch [0.794 cm] diameter),
- 3 of Stock #1152 (36-inch [91.44 cm] length; 1 1/32-inch [0.873 cm] diameter), and
- 3 of Stock #1153 (36-inch [91.44 cm] length; 3/8-inch [0.953 cm] diameter).

Using an electric saw with tine teeth, cut each 91.44-cm rod in half. Then sand off any excess metal that is left from the cutting and mark off 5 cm from each end with a permanent marker. Telescope the 4 different sizes of rods, with an overlap of 5 cm, to make one rod. Using an electric drill with a drill bit with a diameter of 1 mm, drill holes through the midpoint of the overlapping sections as well as 2.5 cm from the ends of the rods (segments) 802 as shown in FIG. 14. With a file, sand off any excess metal left from the drilling. Using standard t-pins 804, lock the rods together and keep the t-pins in place by bending them at the tapered end as shown in FIG. 14. After doing this for all of the rods, the result should be six 168-cm telescoped rods.

Then cut out two pieces of 100% polyester fabric 808, 810 with the dimensions shown in FIG. 15. Then follow the general scheme of FIG. 12 using the 168-cm telescoped brass rods 710 for the rods and generic white sewing elastic (1/4-inch [0.625 cm] width, g-yard [7.32 m] length) for the vertical strings 712, 714, 716 only. (Note: when telescoping, the larger rods are near the base.) Cut these elastics to have rest lengths of 98 cm, not including extraneous elastic of 8 cm at both ends to use for attaching the elastics to the rods. 12 of these elastics will be needed because vertical string 806 will be double-layered as shown in FIG. 16. The top strings and the base strings in FIG. 12 will not exist in the final tent and will be replaced by the sides of the hexagonal pieces of fabric 808, 810 as shown in FIG. 17. Connecting the elastics and the fabric to the rods for both the top and the bottom can be done by following the diagram in FIG. 18. FIGS. 12, 16, 17, and 18 can be used collectively as a reference when assembling the tent. The resulting skeleton tent should look like that which is shown in FIG. 17.

Using material used for clear heavy duty tablecovers (137.16 cm×274.32 cm), cut out 2 pieces of interior fabric A 816 and 4 pieces of interior fabric B 818 with the dimensions shown in FIG. 19. Extraneous cloth is left along the sides as shown in the same figure. The interior fabrics are sewn together by following the pattern in FIG. 20.

Line the interior of the skeleton of the tent (inside of the brass rods) with the sewn pattern of interior fabrics and align the bottoms and tops of the interior fabric to sides of corresponding lengths of the bottom and top of the tent skeleton. The top, bottom, and sides of each interior fabric section (section A or B) 816, 818 will follow the twisted trapezoid created by the brass rods and the top and bottom sides of the tent skeleton. Fasten the interior fabric 900 to the rods 902 by the pins 906 as shown in FIG. 21, a modification of the attachment shown in FIG. 18. Attaching the interior fabric 900 to the skeleton should be done at every vertex of the interior fabric sections except the bottom unsown vertex of the door as indicated in FIG. 20. This is the only unattached vertex.

Stabilize the bottom of the interior fabric by clipping the bottoms of the interior fabric 816 to the bottoms hexagonal piece of fabric 810, 900 (except the door) as seen in FIG. 23. Compare the final tent to FIG. 25 and adjust accordingly.

EXAMPLE 2

The model of a single stage tent, shown in FIG. 12, was constructed using 6 rods, 12 caps, and 18 strings from the a Tensegritoy kit (available from 0-0-0Checkmate). Following the schematics as shown in FIG. 12, the top strings was shortened to 3 cm and the base strings was lengthened to 15 cm.

The model for a double-stage tent was constructed using 12 rods, 24 caps, and 36 strings. Following the schematics for a double-stage tensegrity shell (FIG. 13), the top strings were shortened to 3 cm and the base strings were lengthened to 15 cm.

EXAMPLE 3

Another exemplary model includes obtaining nine aluminum K&S Telescoping Rods:

3 of Stock #1113 (36-inch [91.44 cm] length; ¼-inch [0.625 cm] diameter), 3 of Stock #1114 (36-inch [91.44 cm] length; 9/32-inch [0.714 cm] diameter), and 3 of Stock #1115 (36-inch [91.44 cm] length; 5/16-inch [0.794 cm] diameter).

Cut each 91.44 cm rod in half with a saw, for example an Ace Hobbi-Hack Saw Model #25347. Then sand off any excess metal that is left from the cutting and mark off 5 cm from each end with a permanent marker. Telescope the 3 different sizes of rods, with an overlap of 5 cm, to make one rod. Tape the three rods together with masking tape and do this with all of them until there are 6 rods, each approximately 127.2 cm in length. Following the scheme of FIG. 12, use the aforementioned 127.2-cm rods for the rods and a string such as StretchRite Elastic Cord Stock #3960. Use the Tensegritoy rubber caps to attach the strings to the rods. The top strings should be 8 cm and the base strings should be 40 cm (these lengths are before any stretching).

For a double-stage model, use the same rods used to build the single-stage tensegrity tent, telescope the rods (stock #1114 and #1115) with 5 cm overlap. These will be the bottom rods and will be approximately 86.4 cm in length. The other cut rods (stock #1113) will be the top rods. Follow the scheme of FIG. 13 using the aforementioned 86.4-cm rods for the bottom rods, the cut rods of stock #1113 for the top rods, and StretchRite Elastic Cord Stock #3960 for the strings. Use Tensegritoy rubber caps to attach the strings to the rods. The top strings should be 8 cm, the base strings should be 40 cm, the saddle strings should be 5 cm, and the vertical strings should be 4 cm (these lengths are rest lengths when no forces are acting on them).

A number of embodiments of the invention have been described. Nevertheless, it will be understood that various modifications may be made without departing from the spirit and scope of the invention. For example, a different number of compression elements (struts), tensile members (tendons) and/or stages (structural units) could be employed to construct a portable, collapsible shelter, the physical and mechanical characteristics of the struts and tendons could be modified, and the materials used for the struts, tendons, and covering can be adapted for differing needs of the user and the environment to which it will be exposed.

What is claimed is:

1. An apparatus comprising:

at least three compression elements, each having a top portion and a bottom portion;

at least three tensile members comprising a top horizontal tensile member, a bottom horizontal tensile member, and a vertical tensile member, wherein each tensile member is connected to at least two compression elements and compresses at least one of the at least two compression elements to form a tensegrity structure;

a fabric cover connected to the compression elements; and a fabric floor connected to the tensegrity structure, wherein the interior of the tensegrity structure is defined by the fabric cover and the fabric floor, and wherein the fabric cover comprises a tensile member that compresses at least one compression element to form the tensegrity structure.

2. An apparatus comprising:

a first tensegrity structure stage and a second tensegrity structure stage;

at least three compression elements, each having a top portion and a bottom portion, in the first stage;

at least three compression elements, each having a top portion and a bottom portion, in the second stage;

at least four tensile members comprising:

a bottom horizontal tensile member that connects the bottom portion of the compression element of the first stage to the bottom portion of an adjacent compression element of the first stage;

a saddle horizontal tensile member that connects the top portion of the compression element of the first stage with the top portion of an adjacent compression element of the first stage and connects the bottom portion of the compression element of the second stage with the bottom portion of an adjacent compression element of the second stage;

a top horizontal tensile member that connects the top portion of the compression element of the second stage with the top portion of an adjacent compression element of the second stage; and a vertical tensile member that connects the top portion of the compression element of the first stage to the top portion of an adjacent compression element of the second stage and connects the bottom portion of the compression element of the second stage with the bottom portion of the compression element of the first stage; and a fabric cover connected to the compression elements in both the first tensegrity structure stage and in the second tensegrity structure stage, wherein the fabric cover further comprises a movable door flap in a side panel of the fabric cover, wherein the compression elements compress the tensile members to form the tensegrity structure stages, and wherein the fabric cover comprises a tensile member that compresses at least one compression element to form the tensegrity structure.

* * * * *

UNITED STATES PATENT AND TRADEMARK OFFICE

CERTIFICATE OF CORRECTION

PATENT NO. : 7,578,307 B2
APPLICATION NO. : 10/394101
DATED : August 25, 2009
INVENTOR(S) : Dana M. Ung It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1022 days.

Signed and Sealed this
First Day of March, 2011

David J. Kappos

David J. Kappos
*Director of the United States Patent and Trademark Office*